US005959228A

United States Patent [19]

Yamaguchi

[11] Patent Number: 5,959,228

[45] Date of Patent: Sep. 28, 1999

[54] KEY SUPPORT DEVICE

[75] Inventor: Tsutomu Yamaguchi, Hamamatsu, Japan

[73] Assignee: Kabushiki Kaisha Kawai Gakki Seisakusho, Shizuoka-ken, Japan

[21] Appl. No.: 08/543,578

[22] Filed: Oct. 16, 1995

[30] Foreign Application Priority Data

Oct. 14, 1994 [JP] Japan ..... 6-275580

[51] Int. Cl.[6] ..... G10C 3/12

[52] U.S. Cl. ..... 84/433; 84/435

[58] Field of Search ..... 84/433, 434, 435

[56] References Cited

U.S. PATENT DOCUMENTS 3,413,885 12/1968 Lely ..... 84/433

4,723,471 2/1988 Sugimoto ..... 84/433

*Primary Examiner*—Cassandra C. Spyrou

*Attorney, Agent, or Firm*—Evenson, McKeown, Edwards & Lenahan, P.L.L.C.

[57] ABSTRACT

There is disclosed a key support device for a keyboard musical instrument including a plurality of keys and a keyboard chassis. The key support device has a support member for rotatably supporting a rear part of each of the plurality of keys on the keyboard chassis. The keys each have a supporting shaft-receiving recess having an arcuately-walled portion defined by an inner peripheral surface which is arcuate and partially open in cross-section. The support member comprises a supporting shaft part having an arcuate portion which has the same radius of curvature as the arcuately-walled portion of the supporting shaft-receiving recess and a central angle of less than 180 degrees, and a support part extending from the supporting shaft part. By this arrangement, the keys are each supported by the support member in a state of the arcuately-walled portion of the supporting shaft-receiving recess and the arcuate portion of the supporting shaft part being in contact with each other.

20 Claims, 9 Drawing Sheets

FIG. 4A
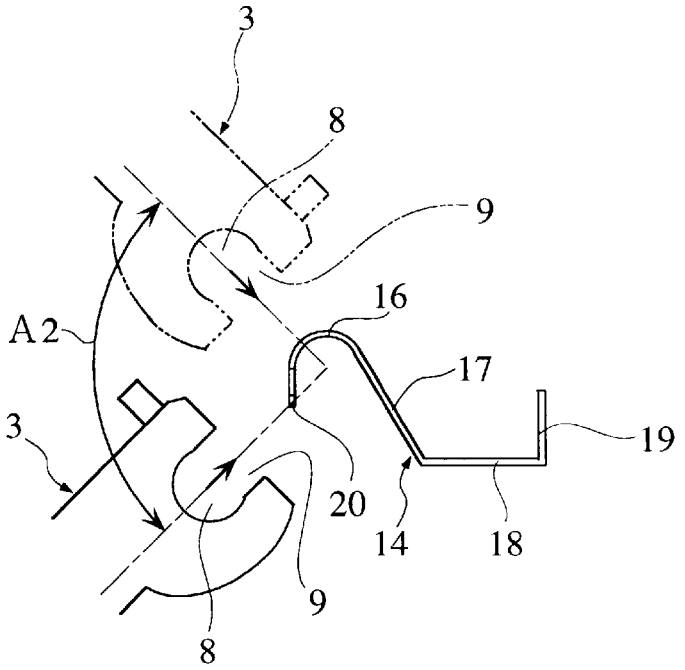
FIG. 4B
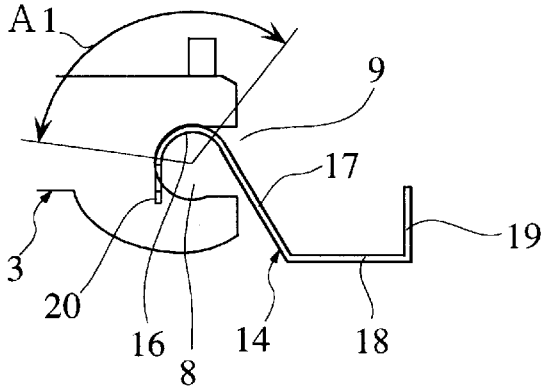
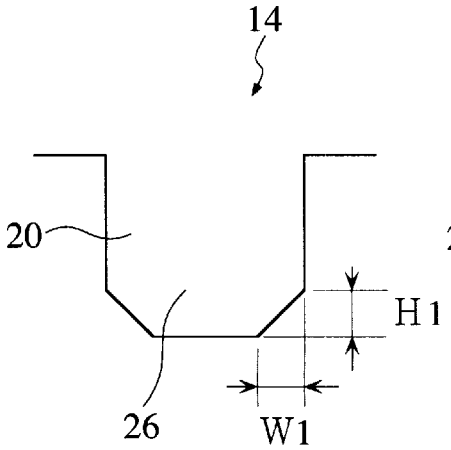
FIG. 5A
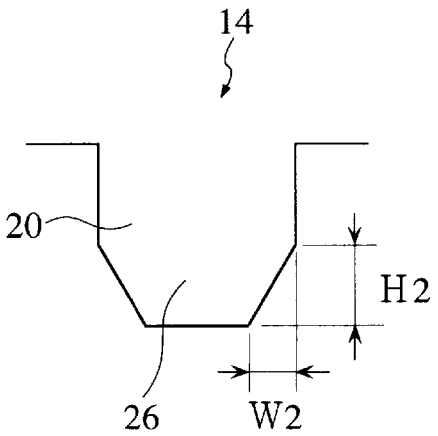
FIG. 5B

KEY SUPPORT DEVICE

BACKGROUND OF THE INVENTION

1. Field of the Invention

This invention relates to a key support device for rotatably supporting keys used in electronic keyboard instruments, such as electronic pianos and electronic organs.

2. Prior Art

A keyboard support device of this kind includes a type which supports rear portions of keys by support members provided on a keyboard chassis. This type of keyboard device is disclosed e.g. in Japanese Patent Publication (Kokoku) No. 3-30875 and Japanese Patent Publication (Kokoku) No. 45-8828.

Japanese Patent Publication (Kokoku) No. 3-30875 discloses:

(1) a key support device constituted by holes punched through part of a keyboard chassis made of metal, and engaging recesses formed in rear ends of keys for direct engagement with the inner peripheral edges of corresponding ones of the holes, respectively, thereby supporting the keys each on the fulcrum of the inner peripheral edge of a corresponding one of the holes, and (2) a key support device constituted by a cylindrical support shaft made of resin mounted on a keyboard chassis, and a shaft-receiving hole formed circular in cross-section through a rear end of each key for engagement with the cylindrical support shaft, thereby supporting each key on the shaft.

Japanese Patent Publication (Kokoku) No. 45-83828 discloses:

(3) a key support device constituted by a support shaft integrally formed with a keyboard chassis, which is semi-circular in dross-section, and a recess defined between a pair of tapered sloping walls formed at a rear end of each key for engagement with the support shaft, thereby supporting each key on the support shaft.

However, the key support device (1) has a drawback that keys are liable to wear, because the inner peripheral edge of each hole formed through the keyboard chassis made of metal is in direct engagement with the engaging recess of each key, which results in a degraded durability of the key support device, and noise is ready to occur.

The key support device (2) is free from the drawback of the key support device (1), because the shaft-receiving hole, circular in cross-section, of each key is engaged with the cylindrical support shaft made of resin. However, not only the material cost is increased due to the resin used for forming the support shaft, but also the assembly work cost is increased due to time required in mounting the support shaft on the keyboard chassis.

Further, the key support device (3), in which the support shaft, semi-circular in cross-section, and the recess, formed by the tapered sloping walls of the key, are engaged with each other, is liable to suffer from looseness or eccentric wear of contact surfaces of these component parts.

SUMMARY OF THE INVENTION

It is the object of the invention to provide a key support device which is capable of supporting keys in position, with higher accuracy, more ease of assembly work therefor, and longer life, at a reduced manufacturing cost.

To attain the above object, the present invention provides a key support device for a keyboard musical instrument including a plurality of keys and a keyboard chassis, the key support device having a support member for rotatably supporting a rear part of each of the plurality of keys on the keyboard chassis.

The key support device according to the invention is characterized in that:

the each of a plurality of keys having a supporting shaft-receiving recess having an arcuately-walled portion defined by an inner peripheral surface which is arcuate and partially open in cross-section;

the support member comprising a supporting shaft part having an arcuate portion which has the same radius of curvature as the arcuately-walled portion of the supporting shaft-receiving recess and a central angle of less than 180 degrees, and a support part extending from the supporting shaft part, whereby the keys are each supported by the support member in a state of the arcuately-walled portion of the supporting shaft-receiving recess and the arcuate portion of the supporting shaft part being in contact with each other.

According to the key support device of the present invention, the supporting shaft-receiving recess is fit via its opening on the supporting shaft part of the support member for engagement therewith, whereby the keys are supported by the support member in the state of the arcuately-walled portion of the supporting shaft-receiving recess and the arcuate portion of the supporting shaft being in contact with each other. Since these portions arcuate in cross-section are brought into contact with each other, the eccentric wear and Looseness of contact surfaces of the associated members are prevented, resulting in a longer life of the key support device. Further, the arcuate portion of the supporting shaft part has a central angle of less than 180 degrees. Therefore, compared with the case of the supporting shaft part having a central angle of 180 degrees, which brings about a limited direction of mounting each key on the support chassis or removing the former from the latter, the freedom of direction of mounting and removal of each key is increased, thereby increasing the freedom of design of the keyboard device as well as facilitating the assembly work.

Preferably, the central angle of the arcuate portion of the supporting shaft part is set to a value in a range of 90 to 150 degrees.

According to this preferred embodiment, since the central angle of the arcuate portion of the supporting shaft part is set to a value in a range of 90 to 150 degrees, there is secured a fully smooth movement of each key due to adequate contact between the arcuate portions, and at the same time, the freedom of direction of mounting and removal of each key is further increased.

Preferably, the support part extends from one end of the arcuate portion of the supporting shaft part.

According to this preferred embodiment, since the support part extends from one end of the arcuate portion of the supporting shaft part, there is secured a Large relief in mounting each key on or removing the same from the supporting shaft part of the support member. The provision of relief reduces interference to the mounting the key on or the removing the same from the support member, and largely increases a range of angles at which the key can be mounted on the support member or removed therefrom. This results in a still greater freedom of design of the keyboard device, and also makes the assembly work even easier. For the same reason, the present key support device permits application to a type of keys supported in a disconnection-proof manner, i.e. which each receive the supporting shaft part of the support member via a narrow opening part of the supporting shaft-receiving recess thereof and then is rotated to a position in which the key is prevented from being disconnected.

It goes without saying that the support member can be made of resin or rubber. However, since the support part of the support member is formed such that it extends from the one end of the arcuate portion of the supporting shaft part, it can be easily shaped from a plate material, e.g. of steel, which increases the number of possible choices of material to be used therefor.

Preferably, the support part extends in a tangential direction from the one end of the arcuate portion of the supporting shaft part.

According to this preferred embodiment, since the support part extends in a tangential direction from the one end of the arcuate portion of the supporting shaft part, part of the support member extending from the supporting shaft part to the support part can be shaped with ease even from a plate of steel without applying a large load on the arcuate portion of the supporting shaft part. This results in an increased accuracy of radius of curvature of the arcuate portion of the supporting shaft part, which permits realization of a high-accuracy keyboard support device at a reduced manufacturing cost. Further, less stress concentrate on a boundary portion between the supporting shaft part and the support, which increases the life of the key support device.

Preferably, the support member is made of a plate of metal.

According to this preferred embodiment, since the support member is made of a plate of metal, the cost of material of the support member can be decreased in comparison with the case of using a resin or a rubber therefor.

Preferably, the support member is formed by part of the keyboard chassis.

According to this preferred embodiment, by forming the support member by part of the keyboard chassis, it is possible to omit the step of assembly of the support member with the keyboard chassis, which reduces the manufacturing cost.

Preferably, the key support device includes resilient members each having one end thereof held on the each of a plurality of keys for causing the each of plurality of keys to restore its position, and the support part extends in a direction substantially parallel with a direction of biasing force of each of the resilient members.

According to this preferred embodiment, since the direction of extension of the support part of the support member and the direction of a stretch of each resilient member for restoring the key to its original position are substantially identical or parallel to each other, the bending moment acting on the support member, which is generated from a component, in a direction perpendicular to the support part, of the biasing force of the resilient member applied via the key to the support member is minimized. Therefore, the support member can be made with a smaller rigidity, and hence the sectional area, i.e. thickness, of the support part can be made small, thereby enabling reduction of the material cost.

Preferably, the support member has holding portions integrally formed therewith for holding the other end of each of the resilient members.

According to this preferred embodiment, since the support member has holding portions integrally formed therewith for holding the other end of each of the resilient members, the number of components of the key board device is reduced, which contributes to reduced dimensional errors between positions of the holding portions and engaged positions of keys. As a result, variation in initial load applied by the resilient member onto each key is reduced, almost dispensing with adjustment works, which leads to a manufacturing cost reduced by the obviated amount of assembly work.

Preferably, the keys each include a top wall and a pair of side walls extending downward from the top wall, the supporting shaft-receiving recess being formed in each of the side walls, the support member having lateral displacement-preventing portions projecting from the other end of the arcuate potion of the supporting shaft part each for engagement between the pair of side walls of a corresponding one of the keys.

According to this preferred embodiment, the lateral displacement-preventing portion projecting from the arcuate portion of the supporting shaft part of the support member engages between the side walls of the hollow-type key. Therefore, it is possible to prevent the lateral displacement of the key, while the lateral displacement-preventing portion also serves as a positioning guide when assembling the key with the key support device, which makes the assembly work still easier.

Preferably, the supporting shaft-receiving recess is formed through the each of a plurality of keys from one side face to an opposite side face thereof, the support member having pairs of lateral displacement-preventing portions extending from the other side of the arcuate portion of the supporting shaft part for engagement of each of the pairs with the one side face and the opposite side face of the key.

According to this preferred embodiment, each pair of lateral displacement-preventing portions engage with the one side face and the opposite side face of each key. Therefore, it is possible to obtain the same effects as obtained by the immediately preceding preferred embodiment.

Preferably, the lateral displacement-preventing portion extends in a tangential direction from the other end of the arcuate portion of the supporting shaft part.

According to this preferred embodiment, since the lateral displacement-preventing portions extend in a tangential direction from the other end of the arcuate portion of the supporting shaft part, it is possible to obtain the same effects as described above with reference to the third preferred embodiment.

Preferably, the lateral displacement-preventing portions each include a guide portion formed by chamfering at least one corner of a front end thereof.

According to this preferred embodiment, since a guide portion is formed by chamfering at least one corner of a front end of each lateral displacement-preventing portion, the each lateral displacement-preventing portion functions as the positioning guide more smoothly, facilitating the assembly work to a further extent, and also enables the key to restore its original position even if the key is slightly moved apart from the support member due to an impact applied thereto.

Preferably, the support member is formed in one piece for supporting a plurality of keys.

According to this preferred embodiment, since the support member is formed in one piece for supporting a plurality of keys, it is possible to reduce the manufacturing cost to a further extent.

Preferably, part of casing enclosing the keyboard chassis is used as a disconnection-preventing potion for preventing the keys from being disconnected from the support member, in a shared manner.

According to this preferred embodiment, since part of casing enclosing the keyboard chassis is used as a disconnection-preventing portion for preventing the keys from being disconnected from the support member, in a shared manner, it is possible to prevent the keys from being disengaged from the support member even more positively at a lower cost.

The above and other objects, features, and advantages of the invention will become more apparent from the following detailed description taken in conjunction with the accompanying drawings.

BRIEF DESCRIPTION OF THE DRAWINGS

FIGS. 4A and 4B are diagrams which are useful in explaining how each key is mounted on the key support device;

FIGS. 5A and 5B are diagrams showing a lateral displacement-preventing portion of the key support device appearing in FIG. 1;

DETAILED DESCRIPTION

The invention will now be described in detail with reference to drawings showing embodiments thereof.

Figure 1:
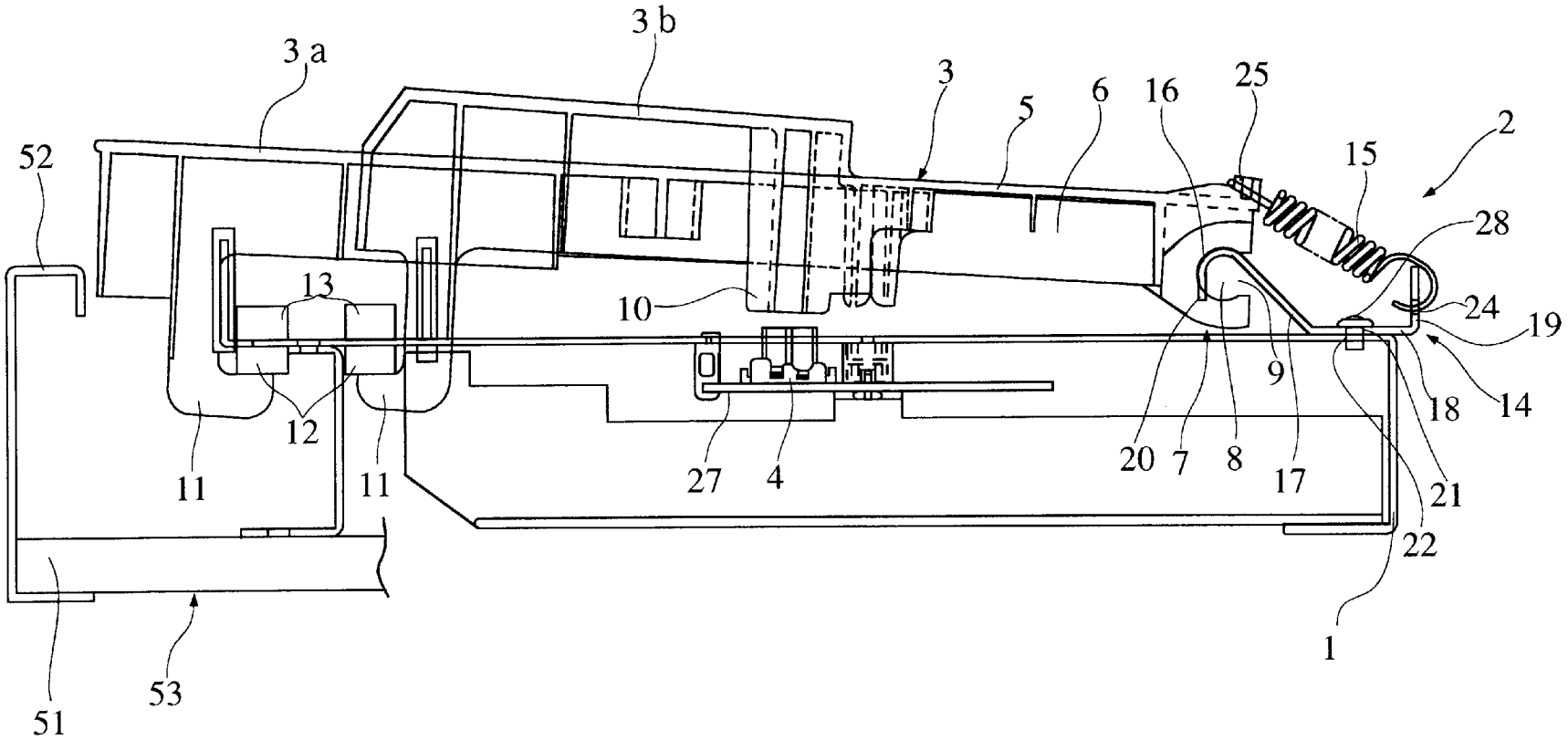
FIG. 1 is a side elevation of a keyboard device for an electronic piano, which is equipped with a key support device according to a first embodiment of the invention.

Referring first to FIG. 1, there is shown a keyboard device for an electronic piano, which is equipped with a key support device according to a first embodiment of the invention. As shown in the figure, the keyboard device is comprised of a keyboard chassis 1, a key support device 2 arranged on a rear part of the keyboard chassis 1, keys 3 each having a rear end thereof rotatably supported by the key support device 2, a plurality of key switches fixed on the keyboard chassis for detecting depression of each key 3, and a casing 53 including a key bed 51 on which the keyboard chassis 1 is rigidly mounted and a key slip 52.

The keyboard chassis 1 is made of a plate of metal, such as steel, and extends in a longitudinal direction, i.e. along the longitudinal axis of each key (in a horizontal direction as viewed from FIG. 1), and also extends in a crosswise direction (in a depth direction as viewed from FIG. 1), for supporting the keys thereon.

Figure 3:
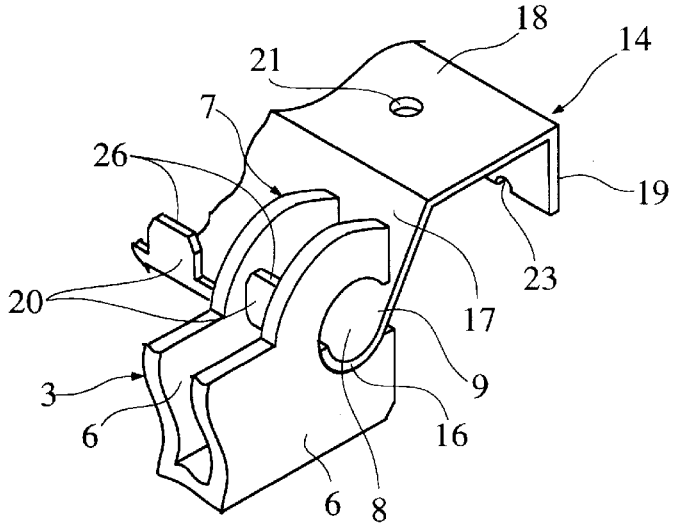
FIG. 3 is a perspective view of the FIG. 2B key support device in an inverted presentation.

The keys 3 are each made of resin, such as an acrylic resin. The keys 3 are classified into two types, white keys 3*a* and black keys 3*b* (one each is shown in the figure). The keys 3 each have a top wall 5, and a pair of side walls 6, 6 extending downward from the sides of the top wall 5 to define therein a hollow space having an inverted U-shaped cross-section, and opening at the bottom and the rear end (see FIG. 3). Each side wall 6 is formed with a support-receiving portion 7 at which the key is supported by the key support device 2. The support-receiving portions 7, 7 are formed with supporting shaft-receiving recesses 8, 8 which are almost circular in cross-section, at respective locations opposed to each other. Each supporting shaft-receiving recess 8 has an arcuately-walled portion having a predetermined central angle (e.g. 270 degrees) and a predetermined radius of curvature, and an opening 9 facing toward the rear side.

The keys 3 are each provided with a key switch-depressing projection 10 at a central location thereof, which extends downward. When each key is in a key-released position, the key switch-depressing projection 10 faces toward a corresponding one of the key switches 4. Further, the keys 3 each have a front end thereof formed with a stopper 11 in the form of a hook, while the keyboard chassis 1 has a front end formed with upper limit stoppers 12 on the bottom surface thereof and with lower limit stoppers 13 on the top surface thereof. The stoppers are formed of felt or the like.

The key support device 2 is comprised of a support member 14 for rotatably supporting the keys 3, and a plurality of coiled springs (resilient members) 15 for causing each key 3 to restore its original key-released position when it is released after being depressed.

Figure 2A:
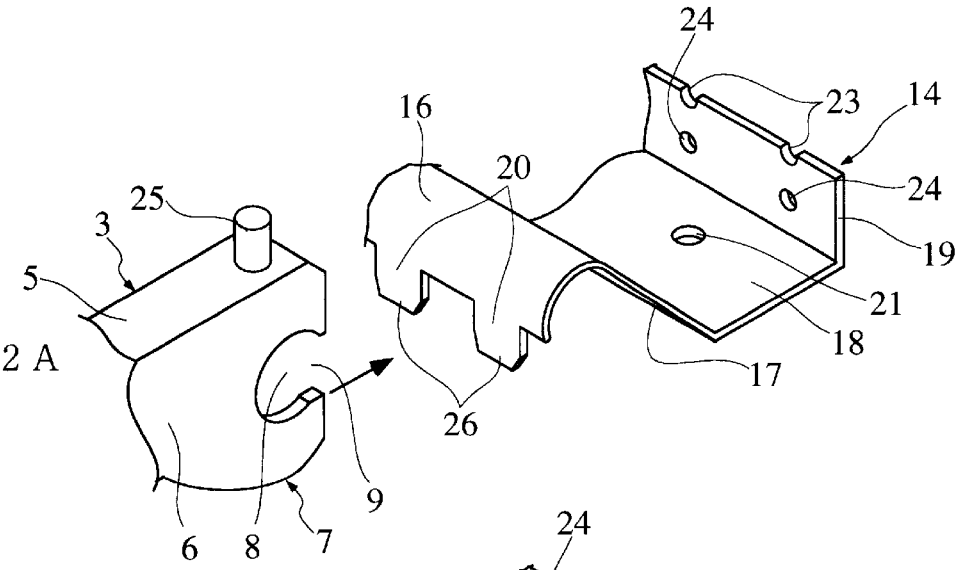
FIG. 2A is an exploded perspective view of the key support device appearing in FIG. 1.
Figure 2B:
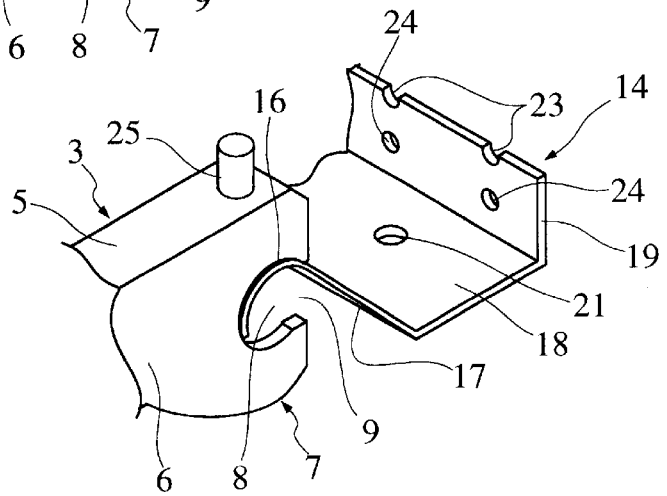
FIG. 2B is a perspective of the FIG. 2A key support device in an engaged state.

The support member 14 supports a plurality of keys 3 at the same time, and shaped from a plate of metal, such as steel, similarly to the keyboard chassis 1. The support member 14 is comprised of, as shown in FIGS. 2A and 2B, a supporting shaft part 16 which is arcuate in cross-section (or has an arcuate portion) for supporting the keys 3 on its outer arcuately-curved surface, a support part 17 extending from a rear end of the supporting shaft part 16, a fixing part 18 extending from a rear end of the support part 17, a spring-engaging part 19 extending upright from a rear end of the fixing part 18, and a plurality of lateral displacement-preventing portions 20 formed at a front end of the supporting shaft part 16.

The supporting shaft part 16 has the same radius of curvature as the arcuately-walled portion of the supporting shaft-receiving recess 8, and a predetermined central angle $A_1$ (e.g. 120 degrees) smaller than the central angle of the arcuately-walled portion of the supporting shaft-receiving recess 8 (see FIG. 4B). The support part 17 extends straight from the rear end of the supporting shaft part 16 in a tangential direction. The fixing portion 18 extends in an oblique direction with respect to the support part 17, and is formed with a through hole 21 via which a screw 28 is screwed into a female screw 22 formed in the keyboard chassis, thereby rigidly fixing the support member 14 to the keyboard chassis 1.

The spring-engaging part 19 holds thereon one end of each coiled spring 15 provided for a corresponding one of the keys 3, with engaging recesses 23 formed at an upper edge thereof for passing each one end of the coiled spring 15 thereon and catch holes 24 at respective locations below the engaging recesses 23, in a manner corresponding to the keys 3, respectively.

The coiled spring 15 has the other end thereof hooked on an engaging projection 25 formed at the rear end portion of the top wall 5 of each key 3. When the coiled spring 15 is stretched between the engaging projection 25 and the spring-engaging part 19 of the support member 14, the coiled spring 15 is substantially parallel to the support part 17 (see FIG. 1). The coiled spring 15 has a function of biasing the key 3 toward the key-released position to thereby cause each key 3 to restore its original key-released position when it is released after being depressed, as well as a function of applying a predetermined initial load to the key 3 and a function of pressing walls of the supporting shaft-receiving recess 8 of the key toward the support part 17 of the support member 14 to hold the key 3 on the support member 14.

The lateral displacement-preventing portions 20 are formed to the shape of the rear end of each key such that they project in a tangential direction from the front end of the supporting shaft part 16 of the support member 14. When the supporting shaft-receiving recess 8 is fit on the supporting shaft part 16 of the support member 14, each lateral displacement-preventing portion 20 is engaged with the side walls 6, 6 of a corresponding key 3 such that it is fit therebetween to serve as a positioning guide of the key 3, and at the same time prevent the key 3 from being displaced in a lateral direction. As shown in FIGS. 5A and 5B, the lateral displacement-preventing portion 20 has a guiding portion 26 formed at corners of a front end thereof.

The guiding portions 26 are each formed by chamfering the corners of the front end of the lateral displacement-preventing portion 20, e.g. by equal dimensions of more than 1 mm for width and height ($W_1$=$H_1$) as shown in FIG. 5A, or by a shorter dimension of more than 1 mm for width and a longer dimension of more than 2 mm for height as shown in FIG. 5B.

The key switches 4 are mounted on an upper face of a printed circuit board 27 fixed to the keyboard chassis 1 at a corresponding location under the key switch-depressing projection 10 of each key. The key switches 4 are each formed by a rubber switch having a pair of switching elements, as shown in FIG. 1. When the key is depressed, the two switching elements are sequentially brought into contact with corresponding contacts, not shown, formed on the printed circuit board 27, at a time interval corresponding to the speed of key depression, whereby the action and speed (velocity) of depression of the key 3 are detected. Based on results of detection by the key switches, a sounding control device, not shown, controls sounding of an electronic piano.

The key slip 52 is rigidly mounted on the key bed 51 at the front end of the latter such that it extends upright therefrom in a manner opposed to the front end face of the white keys 3*a* with a predetermined space interval, thereby covering the lower part of the keyboard device and restricting the forward movement of the white keys 3*a* by allowing the same to abut thereon when they are moved forward by an impact applied thereto, to thereby prevent the white keys 3*a* from being disconnected from the support member 14.

According to the above arrangement of the key support device 2, the keys 3 are supported on the keyboard chassis 1 in the following manner:

First, as shown in FIG. 1, the support member 14 is rigidly fixed to the keyboard chassis 1 by screwing the screw 28 through the screw hole 21 of the support member 14 into the female screw 22 formed in the keyboard chassis 1. Then, as shown in FIGS. 2A and 2B, the supporting shaft-receiving recess 8 of each key 3 is fit on the supporting shaft part 16 of the support member 14 via the opening 9 thereof to cause the supporting shaft part 16 to support the supporting shaft-receiving recess 8 of the key 3 (see FIG. 3). Finally, the coiled springs 15 are hooked on the engaging projections 25 of the keys 3 and the catch holes 24 of the support member 14. This completes the mounting of the keys 3 on the keyboard chassis 1 (see FIG. 1). In the case of black keys 3*b*, after the keys 3 are set on the keyboard chassis 1 such that the upper limit stopper 12 and the lower limit stopper 13 function properly, the supporting shaft part 16 of the support member 14 is fit into the supporting shaft-receiving recess 8 of each key 3*b* via its opening 9 for engagement therewith, thereby causing the keys 3*b* to be supported by the support member 14, and finally the coiled springs 15 are hooked on the engaging projections 25 of the keys 3 and the catch holes 24 of the support member 14.

Since the central angle of the supporting shaft part 16 is set e.g. to 120 degrees, which is less than 180 degrees, and the support part 17 extends from only one end of the supporting shaft part 16, there is secured "relief" on the other end side of the supporting shaft part 16, which makes it easy to insert the supporting shaft part 16 of the support member 14 into the supporting shaft-receiving recess 8 formed at the rear end of the key 3.

Figure 16A:
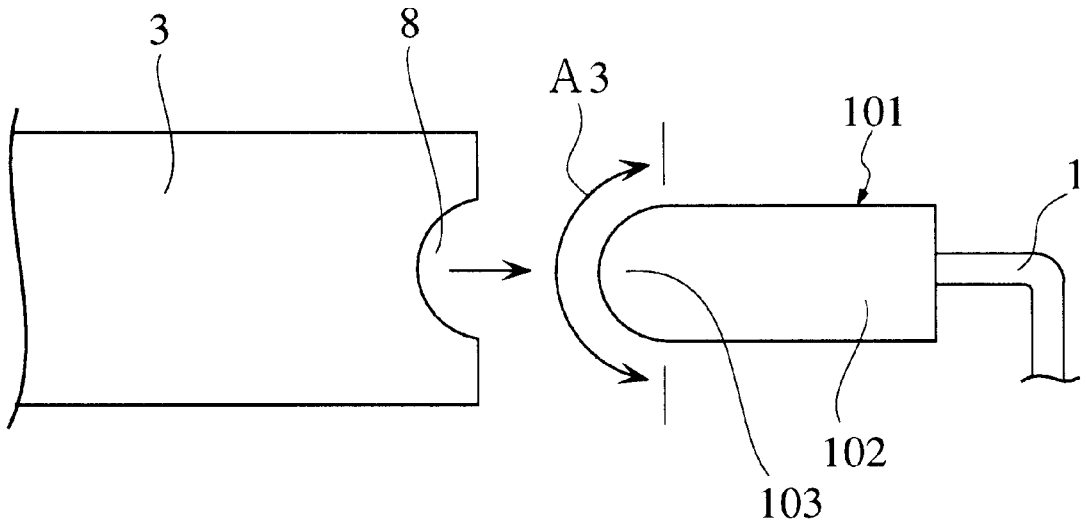
FIGS. 16A and 16B are diagrams which are useful in explaining how keys are mounted on conventional key support devices.
Figure 16B:
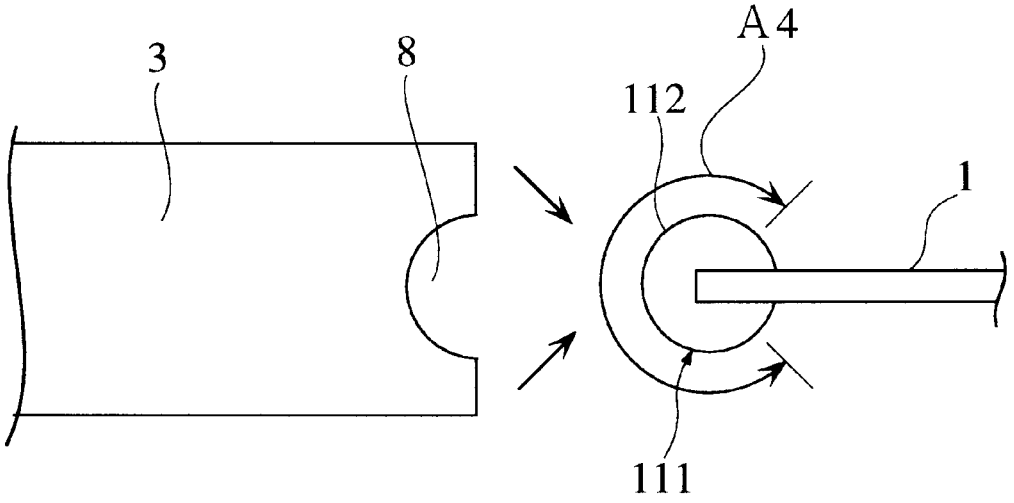

FIGS. 16A and 16B show conventional support members for comparison in this respect. FIG. 16A shows a support member 101 including a supporting part 102 with an arcuate portion 103 having a front end face arcuate in cross-section. The front end face has a central angle $A_3$ of 180 degrees, which restricts the direction of insertion of the key 3 to one direction indicated by an arrow in the figure. FIG. 16B shows a support member 111 which has an arcuate portion 112 with a central angle $A_4$ of nearly 360 degrees, and hence is free from the inconvenience of the FIG. 16A support member 101. However, from a practical point of view, it is difficult to shape metal into such an arcuate part having a central angle exceeding 180 degrees. The support member 14 of the present embodiment can eliminate such drawbacks of the prior art. That is, the present support member 14 can be made from a plate of metal, which is less expensive than a resin or a rubber, such that it has an increased freedom of direction of insertion and removal of the key 3, which permits the keyboard device to be designed with more freedom and to be assembled with more ease.

For the same reason, the present invention can be applied to a type of key which is supported in a disconnection-proof manner, i.e. which receives via the narrow opening 9 thereof the supporting shaft part 16 of the support member 14 into the supporting shaft-receiving recess 8, and is rotated to a position in which the key 3 is prevented from being disconnected, as is the case with the present embodiment.

Further, when the supporting shaft-receiving recess 8 is fit on the supporting shaft part 16, the lateral displacement-preventing portions 20 of the support member 14 are engaged with the side walls 6, 6 of the key 3 to serve as a position guide of the key 3. This makes the assembly work still easier. Further, the lateral displacement-preventing portions 20 are easy to be engaged between the side walls 6, 6 by virtue of the guiding portions 26 formed at the front end of each lateral displacement-preventing portions 20. This makes it even easier to assemble each key 3 with the key support device 2, and further makes it possible for the key 3 to smoothly restore its position when it gets apart from the support member 14 to some extent due to an impact applied thereto.

Further, when the key 3 is in the state of being supported by the support member 14, the supporting shaft-receiving recess 8 and the supporting shaft part 16 of the support member 14 are in contact with each other at respective arcuate portions, i.e. an inner peripheral face of the recess 8 arcuate in cross-section and an cuter peripheral surface of the supporting shaft part 16 also arcuate in cross-section. Such contact of the arcuate portions reduces wear of contact surfaces and the resulting looseness of these associated parts. This leads to an increased durability or life of the assembly of the keys 3 and the key support device 2. Further, the central angle of 120 degrees of the supporting shaft part 16 of the support member 14 ensures the smooth rotation of the keys 3 rotatably supported thereon.

The support part 17 of the support member 14 and lateral displacement-preventing portions 20 extend in respective tangential directions from the opposite ends of the supporting shaft part 16. Therefore, these portions can be shaped with ease even from a plate of steel without applying a large load on the supporting shaft part 16. This results in an increased accuracy of radius of curvature of the supporting shaft part 16, realizing a high-accuracy keyboard support device at a reduced manufacturing cost. Further, less stress concentrate on a boundary portion between the supporting shaft part 16 and the support part 17, and a boundary portion between the supporting shaft part 16 and the lateral displacement-preventing portions 20, which increases the life of the key support device.

The coiled spring 15 is stretched substantially parallel to the support part 17, which results in the minimum of the bending moment acting on the support member, which is generated from a component, in a direction perpendicular to the support part, of the biasing force of the resilient member applied via the keys 3 to the support member 14. Therefore, the support member 14 can be made with a smaller rigidity, and hence the sectional area, i.e. thickness, of the support part 17 can be made smaller, thereby enabling reduction of the material cost.

Further, the spring-engaging part 19 for holding or hooking the coiled spring 15 is formed as an integral part of the support member 14, which reduces the number of components of the key board device, and contributes to reduced dimensional errors between the spring-engaging part 19 and the engaging projections 25 on the keys 3. As a result, variation in the initial load applied by the coiled springs 15 onto the keys 3 is reduced, almost dispensing with adjustment works, leading to a reduced manufacturing cost by the obviated amount of assembly work.

Figure 6:
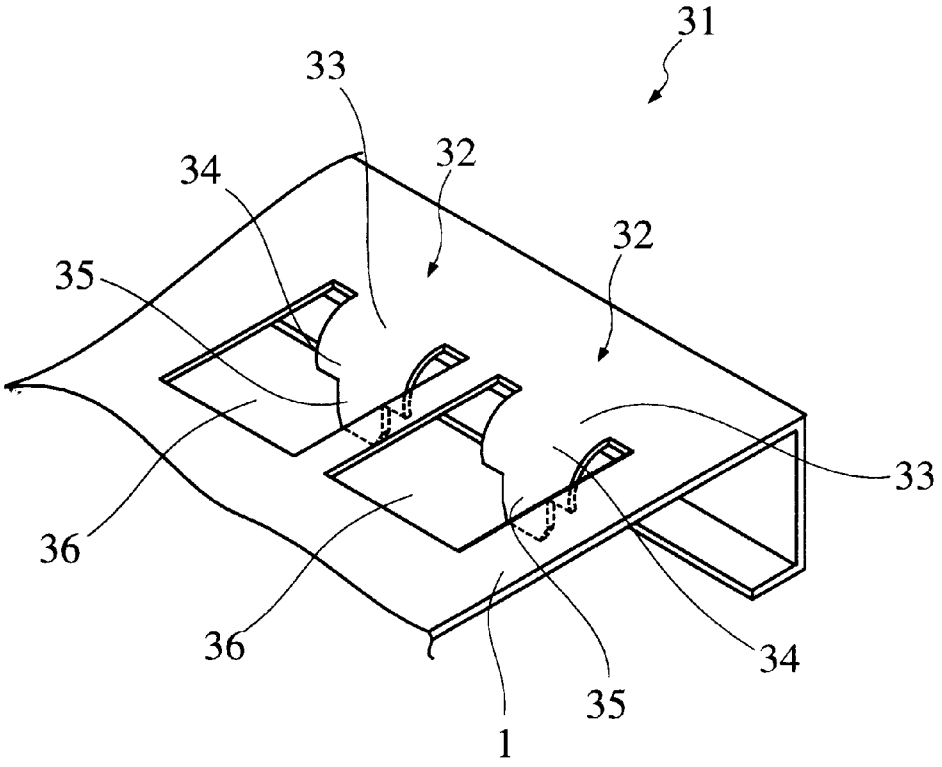
FIG. 6 is a perspective view of a key support device according to a second embodiment of the invention.
Figure 7:
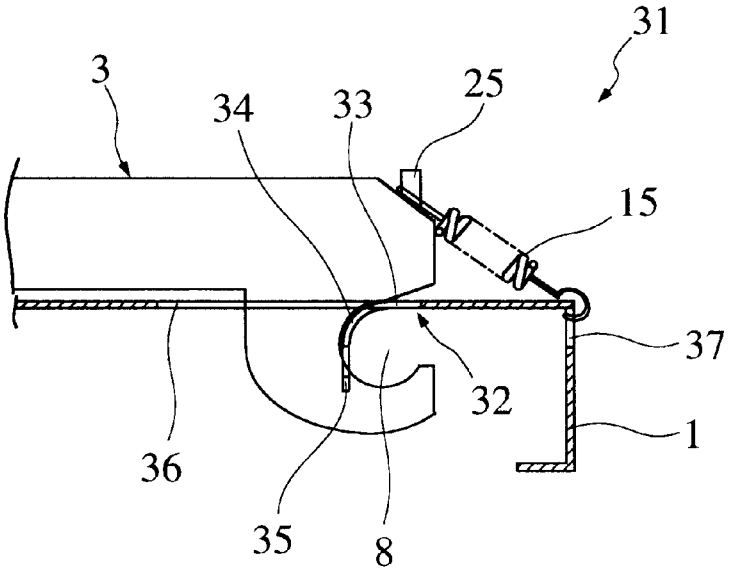
FIG. 7 is a side elevation, partly in section, of the FIG. 6 key support device.

FIGS. 6 and 7 show a key support device 31 according to a second embodiment of the invention. This embodiment is distinguished from the first embodiment only in that the key support device 31 has a support member 32 formed by part of the keyboard chassis 1. More specifically, the key support member 32 of the key support device 31 includes a support part 33 formed by a portion of a horizontally extending part of the keyboard chassis 1, as well as supporting shaft parts 34 and lateral displacement-preventing portions 35 which continuously extend from a front end of the support part 33 into an opening 34 formed in the horizontally extending part of the keyboard chassis 1, in a progressively declining manner. At the rear end of the keyboard chassis 1, there are formed catch holes 37 for catching the coiled springs 15.

The key support device 31 can attain similar effects as described above with the first embodiment, and further it is advantageous in that a step of assembling the support member 32 with the keyboard chassis 1 can be omitted, which contributes to reduction of the manufacturing cost.

Figure 8:
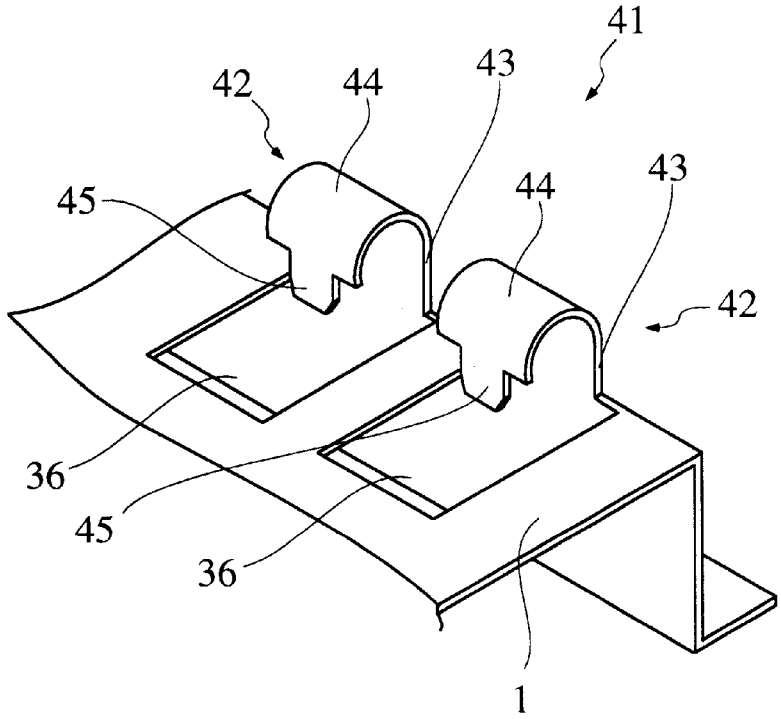
FIG. 8 is a perspective view of a key support device according to a third embodiment of the invention.
Figure 9:
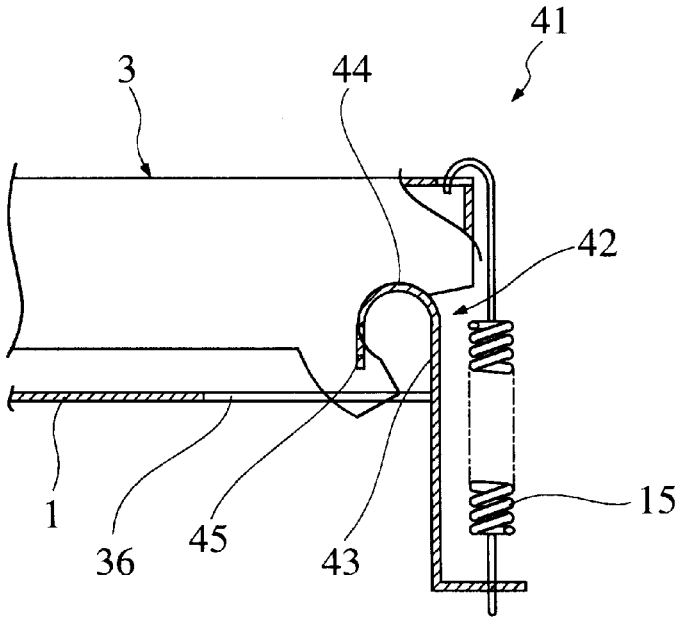
FIG. 9 is a side elevation, partly in section, of the FIG. 8 key support device.

FIG. 8 and FIG. 9 shows a key support device 41 according to a third embodiment of the invention.

The key support device 41 has a support member 42 formed by part of the keyboard chassis i similarly to the key support device 31 of the second embodiment. The third embodiment is distinguished from the second embodiment in that it has support parts 43, supporting shaft parts 44, and lateral displacement-preventing portions 45, each combination thereof as a part which is cut out on three sides thereof from the horizontally extending part of the keyboard chassis 1 and raised upward to form a substantially arcuate shape having an arcuate portion which is arcuate in longitudinal cross-section. Therefore, this embodiment can attain quite the same effects as the second embodiment.

FIGS. 10A, 10B and FIG. 11, FIGS. 12 and 13, and FIGS. 14 and 15 show key support devices according fourth to six embodiments of the invention. These embodiments are distinguished from the first to third embodiments described above in that they support solid-type keys 3 instead of the hollow-type keys 3 formed by the top wall 5 and the side walls 6, 6 described in the above embodiments.

Figure 10A:
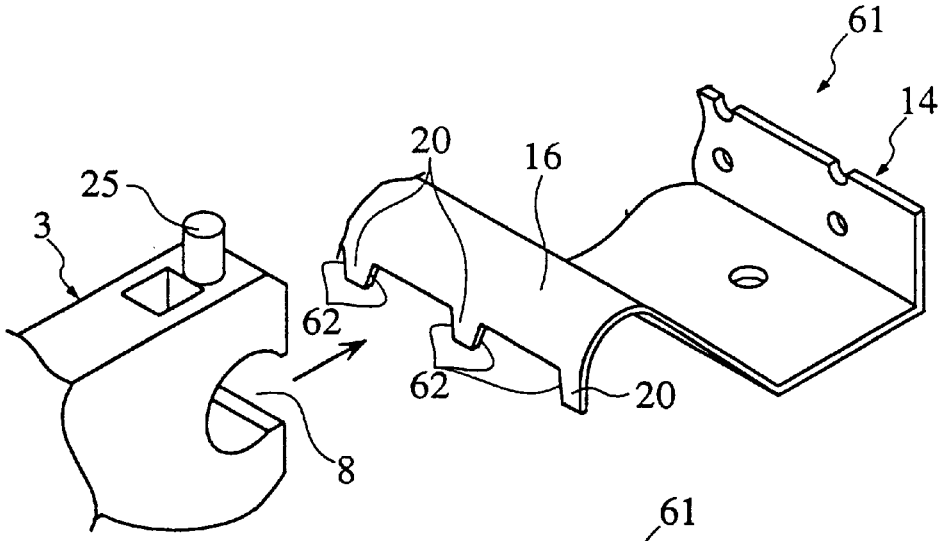
FIG. 10A is an exploded perspective view of a key support device according to a fourth embodiment of the invention.
Figure 10B:
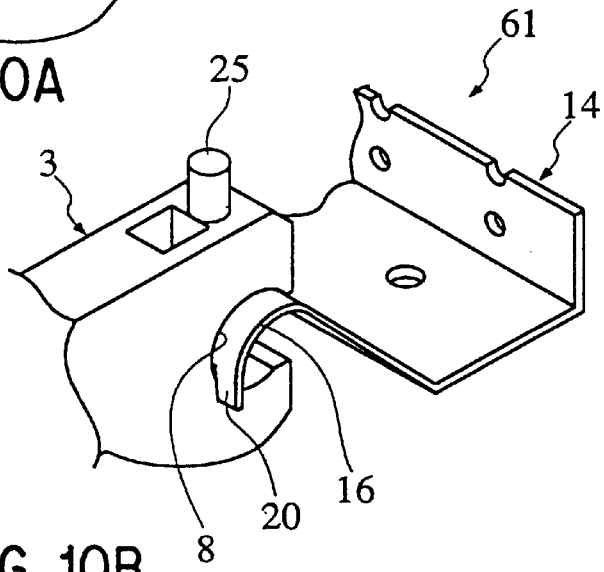
FIG. 10B is a perspective of the FIG. 10A key support device in an engaged state.
Figure 11:
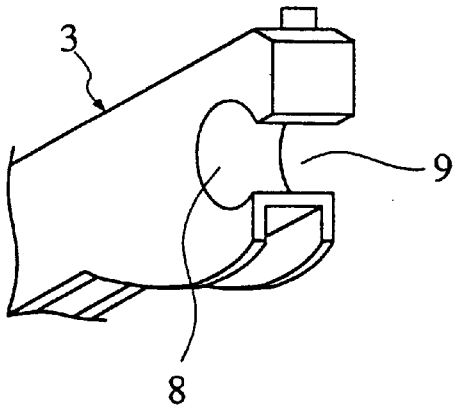
FIG. 11 is a perspective view showing a rear end portion of the key for being supported by the key support device shown in FIGS. 10A and 10B.

Therefore, in a key support device 61 shown in FIGS. 10A, 10B, and 11, the solid-type keys 3 are each formed with the supporting shaft-receiving recess 8 which continuously extend from side face to side face at the read end of its solid body. On the other hand, the supporting shaft part 16 of the support member 14 has blocks divided in a manner corresponding to respective recesses formed at the front end of the supporting shaft part 16 to a substantially equal width defined by adjacent lateral displacement-preventing portions 20. The key 3 is supported by the support member 14 in a state of the supporting shaft-receiving recess 8 being engaged with a corresponding block of the supporting shaft part 16. Adjacent ones of the lateral displacement-preventing portions 20 form each pair for engagement on the opposite side faces of the solid rear end of the key 3. Each lateral displacement-preventing portion 20 extend in a tangential direction from the front end of the supporting shaft part 16, and is formed with a taper on lateral sides thereof so as to serve as a guide 62. The remainder of the arrangement of the key support device 61 is similar to that of the first embodiment. Therefore, this embodiment is capable of supporting the sold-type keys 3 while attaining the same effects as attained by the first embodiment.

Figure 12:
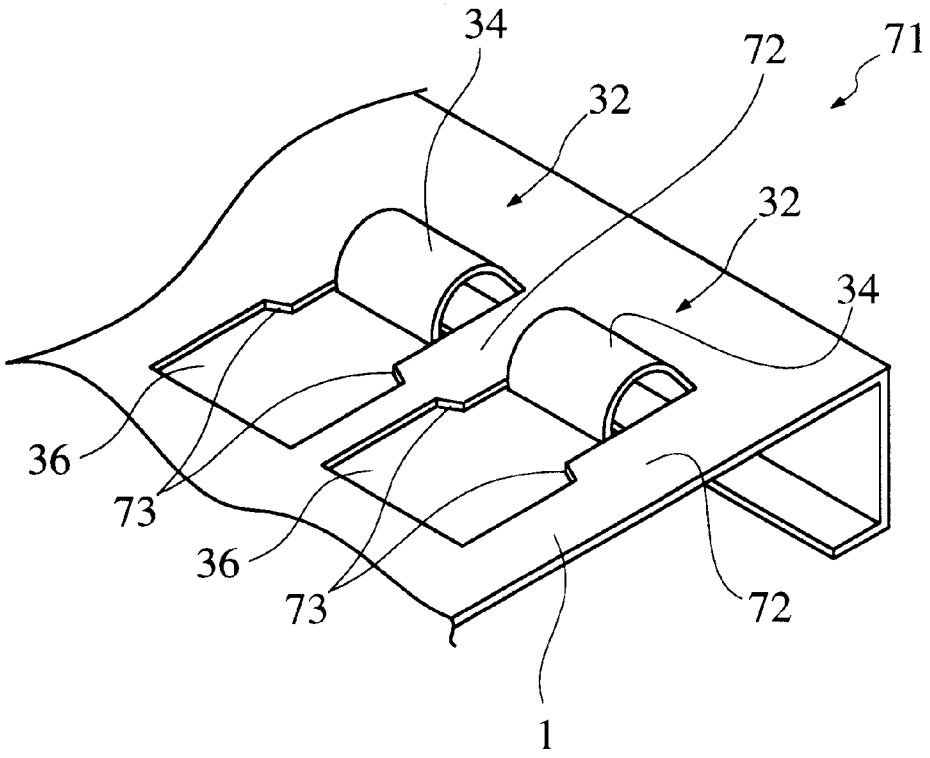
FIG. 12 is a perspective view of a key support device according to a fifth embodiment of the invention.
Figure 13:
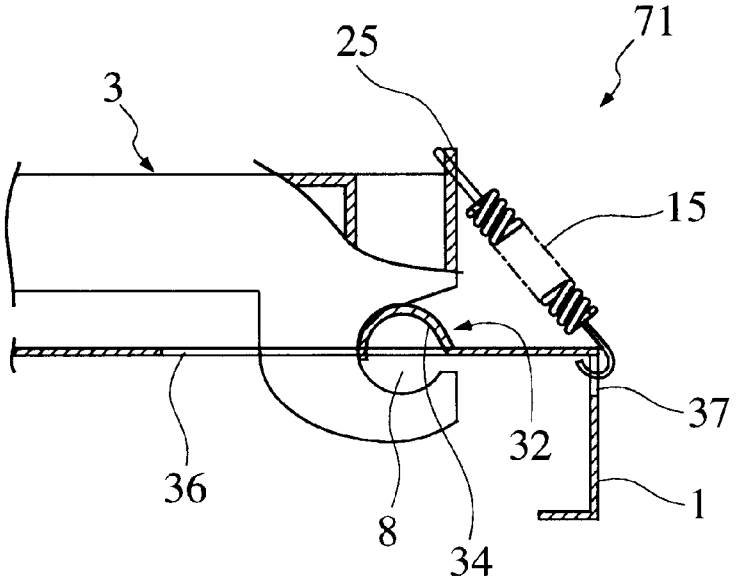
FIG. 13 is a side elevation, partly in section, of the FIG. 12 key support device.

FIGS. 12 and 13 show a key support device 71 according to the fifth embodiment of the invention, which corresponds to the key support device 31 of the second embodiment. That is, the key support device 71 has a key support member 32 formed by a portion of a horizontally extending part of the keyboard chassis 1, and supporting shaft parts 34 thereof are each cut out on three sides thereof from the horizontally extending part of the keyboard chassis 1 and raised upward to form a substantially arcuate shape having an arcuate portion which is arcuate in cross-section. Further, the lateral displacement-preventing portions 72 are defined between inner longitudinal sides of rear parts of openings 36 which are decreased in width via tapering guides 73 formed on the longitudinal sides of the openings 36. The remainder of the arrangement of the key support device 71 is similar to that of the second embodiment. Therefore, the key support device 71 of the present embodiment is capable of supporting the sold-type keys 3 while attaining the same effects as obtained by the key support device 31 of the second embodiment.

Figure 14:
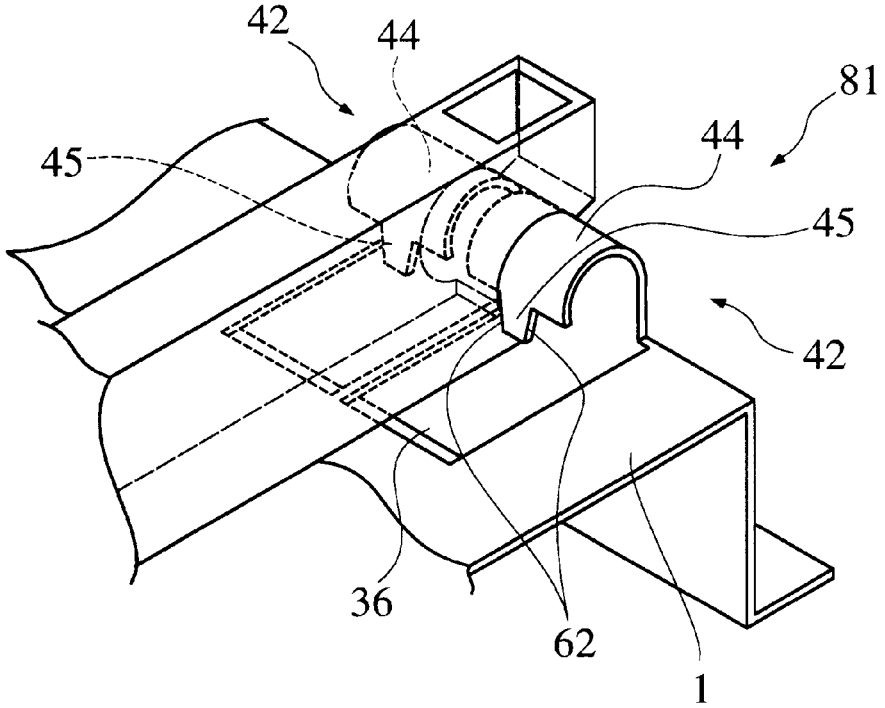
FIG. 14 is a perspective view of a key support device according to a sixth embodiment of the invention.
Figure 15:
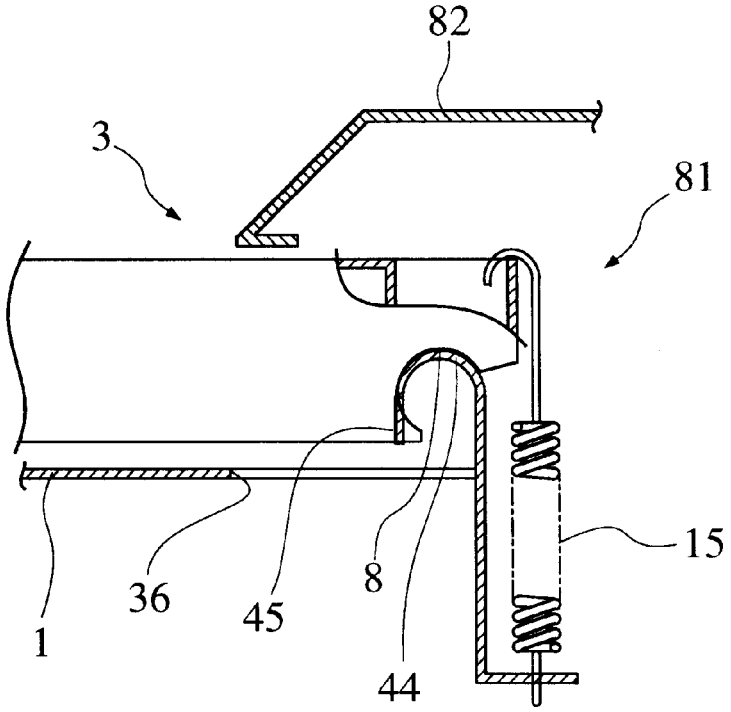
FIG. 15 is a side elevation, partly in section, of the FIG. 14 key support device.

FIGS. 14 and 15 shows a key support device 81 according to the sixth embodiment of the invention, which corresponds to the keys support device 31 of the third embodiment. That is, in the present embodiment, the support member 42 of the key support device 81 has a supporting shaft part 44 and a lateral displacement-preventing portion 45 formed by part cut out on three sides thereof from the horizontally extending part of the keyboard chassis 1 and raised upward to form a substantially arcuate shape having an arcuate portion which is arcuate in cross-section. The support shaft-receiving recess 8 is engaged with opposed supporting shaft parts 44 of the adjacent support members 42, 42 in a stretching manner, with the lateral displacement-preventing portions 45, 45 of the adjacent support members 42, 42 engaging with opposite side faces of the key 3. The remainder of the arrangement of the key support device 81 is similar to that of the third embodiment. Therefore, the key support device 81 of the present embodiment is capable of supporting the sold-type keys 3 while attaining the same effects as attained by the key support device 41 of the third embodiment.

Further, in FIG. 15, reference numeral 82 designates an upper casing of a control panel provided close to the keys 3. The upper casing 82 restricts the upward movement of the keys 3 by allowing the same to abut thereon when moved upward by an impact applied thereto, to thereby prevent the keys 3 from being disconnected from the support member 42.

The present invention is by no means limited to the above embodiments described only by way of illustration, but can be carried out in the form of various modifications thereof. For example, although in the above embodiments, the support member is made of a plate of metal, this is not imitative, but the support member may be formed by a resin or a rubber when it is formed as a separate part to be assembled with the keyboard chassis as in the first embodiment. However, from a viewpoint of manufacturing cost, the plate of metal is advantageous over such materials. Further, although, in the embodiment, the lateral displacement-preventing portions are each formed with guiding portions at corners or sides of the front end thereof, this is not imitative, but one guiding portion may be provided on one corner or side of the lateral displacement-preventing portion. Although, the invention is applied to the electronic piano in the above embodiments, this is not imitative, but it goes without saying that the present invention can be applied to keyboard instruments other than the electronic piano.

It is further understood by those skilled in the art that the foregoing is a preferred embodiment of the invention, and that various changes and modifications may be without departing from the spirit and scope thereof.

What is claimed is:

1. In a key support device for a keyboard musical instrument including a plurality of keys and a keyboard chassis, said key support device having a support member for rotatably supporting a rear part of each of said plurality of keys on said keyboard chassis, the improvement wherein said each of a plurality of keys having a supporting shaft-receiving recess having an arcuately-walled portion defined by an inner peripheral surface which is arcuate and partially open in cross-section;

said support member comprising a supporting shaft part having an arcuate portion which has the same radius of curvature as said arcuately-walled portion of said supporting shaft-receiving recess and a central angle of less than 180 degrees, and a support part extending from said supporting shaft part;

whereby said keys are each supported by said support member in a state of said arcuately-walled portion of said supporting shaft-receiving recess and said arcuate portion of said supporting shaft part being in contact with each other.

2. A key support device according to claim 1, wherein said central angle of said arcuate portion of said supporting shaft part is set to a value in a range of 90 to 150 degrees.

3. A key support device according to claim 1 or 2, wherein said support part extends from one end of said arcuate portion of said supporting shaft part.

4. A key support device according to claim 3, wherein said support part extends in a tangential direction from said one end of said arcuate portion of said supporting shaft part.

5. A key support device according to claim 1 or 2, wherein said support member is made of a plate of metal.

6. A key support device according to claim 5, wherein said support member is formed by part of said keyboard chassis.

7. A key support device according to claim 1 or 2, including resilient members each having one end thereof held on said each of a plurality of keys for causing said each of plurality of keys to restore its position, wherein said support part extends in a direction substantially parallel with a direction of biasing force of each of said resilient members.

8. A key support device according to claim 3, including resilient members each having one end thereof held on said each of a plurality of keys for causing said each of plurality of keys to restore its position, wherein said support part extends in a direction substantially parallel with a direction of biasing force of each of said resilient members.

9. A key support device according to claim 4, including resilient members each having one end thereof held on said each of a plurality of keys for causing said each of plurality of keys to restore its position, wherein said support part extends in a direction substantially parallel with a direction of biasing force of a corresponding one of said resilient members.

10. A key support device according to claim 7, wherein said support member has holding portions integrally formed therewith for holding the other end of each of said resilient members.

11. A key support device according to claim 8, wherein said support member has holding portions integrally formed therewith for holding the other end of each of said resilient members.

12. A key support device according to claim 9, wherein said support member has holding portions integrally formed therewith for holding the other end of each of said resilient members.

13. A key support device according to claim 1 or 2, wherein said keys each include a top wall and a pair of side walls extending downward from said top wall, said supporting shaft-receiving recess being formed in each of said side walls, said support member having a lateral displacement-preventing portion projecting from the other end of said arcuate potion of said supporting shaft part for engagement between said pair of side walls.

14. A key support device according to claim 1 or 2, wherein said supporting shaft-receiving recess is formed through said each of a plurality of keys from one side face to an opposite side face thereof, said support member having pairs of lateral displacement-preventing portions extending from the other side of said arcuate portion of said supporting shaft part for engagement of each of said pairs of lateral displacement-preventing portions with said one side face and said opposite side face of said key.

15. A key support device according to claim 13, wherein said lateral displacement-preventing portions each extend in a tangential direction from the other end of said arcuate portion of said supporting shaft part.

16. A key support device according to claim 14, wherein said lateral displacement-preventing portions each include a guide portion formed by chamfering at least one corner of a front end thereof.

17. A key support device according to claim 15, wherein said lateral displacement-preventing portions each extend in a tangential direction from the other end of said arcuate portion of said supporting shaft part.

18. A key support device according to claim 16, wherein said pair of lateral displacement-preventing portions each include a guide portion formed by chamfering at least one corner of a front end of said lateral displacement-preventing portion.

19. A key support device according to claim, 1, wherein said support member is formed in one piece for supporting said plurality of keys.

20. A key support device according to claim 1, further comprising a casing enclosing said keyboard chassis, wherein a part of said casing is used as a disconnection-preventing portion for preventing said keys from being disconnected from said support member.

* * * * *